US010055922B2

(12) United States Patent
Ma et al.

(10) Patent No.: US 10,055,922 B2
(45) Date of Patent: Aug. 21, 2018

(54) BANKNOTE POSITION DETECTION DEVICE

(71) Applicant: GRG Banking Equipment Co., Ltd., Guangzhou, Guangdong (CN)

(72) Inventors: Faqing Ma, Guangdong (CN); Zhiqiang Sun, Guangdong (CN); Zhuang Jiang, Guangdong (CN); Zhefeng Hong, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/563,895

(22) PCT Filed: Apr. 6, 2016

(86) PCT No.: PCT/CN2016/078533
§ 371 (c)(1),
(2) Date: Oct. 2, 2017

(87) PCT Pub. No.: WO2016/173388
PCT Pub. Date: Nov. 3, 2016

(65) Prior Publication Data

US 2018/0122175 A1 May 3, 2018

(30) Foreign Application Priority Data

Apr. 28, 2015 (CN) ..... 2015 1 0210261

(51) Int. Cl.
*G07D 11/00* (2006.01)
*G07D 7/17* (2016.01)

(52) U.S. Cl.
CPC ..... *G07D 11/0021* (2013.01); *G07D 7/17* (2017.05); *G07D 11/0018* (2013.01); *G07D 11/0036* (2013.01)

(58) Field of Classification Search
CPC .. G07D 11/0021; G07D 7/17; G07D 11/0036; G07D 11/0018; G07D 7/12;
(Continued)

(56) References Cited

U.S. PATENT DOCUMENTS 5,476,169 A * 12/1995 Takarada ..... G07D 7/12 194/207
5,498,879 A * 3/1996 De Man ..... G07D 7/121 250/226

(Continued)

FOREIGN PATENT DOCUMENTS

CN 2531460 Y 1/2003
CN 101105873 A 1/2008

(Continued)

OTHER PUBLICATIONS

International Search Report and Written Opinion for Application No. PCT/CN2016/078533 dated Jun. 28, 2016, and English translation of the International Search Report.

(Continued)

*Primary Examiner* — Mohamed K Amara
(74) *Attorney, Agent, or Firm* — Wolf, Greenfield & Sacks, P.C.

(57) ABSTRACT

An apparatus for detecting a banknote location is provided, which includes a first, second and third photoelectric sensors installed respectively at the entrance, exit and inside of a banknote passage. The first photoelectric sensor includes a light-emitting end, a light-receiving end, a first reflecting mirror and a second reflecting mirror, for detecting whether a banknote reaches the entrance. The second photoelectric sensor includes a light-emitting end, a light-receiving end, a third reflecting mirror and a fourth reflecting mirror, for detecting whether a banknote reaches the exit. The third photoelectric sensor includes a light-emitting end, a light-receiving end, an upper reflecting mirror group and a lower (Continued)

reflecting mirror group, for detecting whether a banknote is inside the passage.

6 Claims, 5 Drawing Sheets

(58) Field of Classification Search
CPC .. G07D 11/0084; G07D 7/1205; G07D 7/205; H04N 1/00037; H04N 2201/3233; H04N 2201/3226; G01N 21/6428; G01N 21/59; G01N 21/3151; G01N 21/031; G01J 3/46; G01J 3/02; G01J 3/10; G01J 3/42; G01J 3/26; G01J 3/0294; G03G 21/046; G03G 15/5087; G03G 15/607; G01B 11/028; G01B 11/24
See application file for complete search history.

(56) References Cited

U.S. PATENT DOCUMENTS 6,050,386 A * 4/2000 Niizuma ..... G07D 11/0081 194/206
6,101,266 A * 8/2000 Laskowski ..... G07D 7/20 382/135
6,605,819 B2 * 8/2003 Ross ..... G07D 7/1205 250/239
6,891,180 B2 * 5/2005 Holl ..... G06K 9/2036 250/216
7,084,416 B2 * 8/2006 Suzuki ..... G07D 7/121 194/207
7,170,074 B2 * 1/2007 Baudat ..... G07D 7/12 250/556
7,269,279 B2 * 9/2007 Chiles ..... G07D 3/16 194/206
7,359,543 B2 * 4/2008 Tsuji ..... G07D 7/121 194/207
7,455,183 B2 * 11/2008 Nishida ..... B65H 31/10 209/534
7,551,764 B2 * 6/2009 Chiles ..... G07D 9/04 194/205
7,584,890 B2 * 9/2009 Mazowiesky ..... G07D 7/121 194/207
7,607,662 B2 * 10/2009 Nireki ..... B65H 5/062 271/265.01
7,639,404 B2 * 12/2009 Ikeno ..... H04N 1/1017 358/461
8,194,236 B2 * 6/2012 Fujimoto ..... G07D 7/205 356/71
8,260,027 B2 * 9/2012 Nireki ..... G07D 7/12 382/135
2001/0030100 A1 * 10/2001 Negishi ..... G07D 7/121 194/302
2004/0125358 A1 * 7/2004 Numata ..... G07D 7/121 356/71
2004/0211904 A1 * 10/2004 Scowen ..... B65H 7/14 250/341.1
2007/0108013 A1 * 5/2007 Nago ..... G07D 7/121 194/302
2009/0022390 A1 * 1/2009 Yacoubian ..... G07D 7/121 382/135
2010/0181162 A1 7/2010 Nagami et al.
2013/0119654 A1 5/2013 Mori et al.

FOREIGN PATENT DOCUMENTS

CN 201185031 Y 1/2009
CN 101794476 A 8/2010
CN 103124987 A 5/2013
CN 203350936 U 12/2013
CN 203909890 U 10/2014
CN 104766402 A 7/2015
JP 2007-141109 A 6/2007
KR 10-2010-0050963 A 5/2010
KR 10-2011-0057026 A 5/2011

OTHER PUBLICATIONS

Written Opinion for International Application No. PCT/CN2016/078533 dated Jun. 28, 2016.

* cited by examiner

BANKNOTE POSITION DETECTION DEVICE

CROSS-REFERENCE TO RELATED APPLICATONS

The present application is the national phase of International Patent Application No. PCT/CN2016/078533 filed on Apr. 6, 2016, which claims priority to Chinese Patent Application No. 201510210261.0, titled "BANKNOTE POSITION DETECTION DEVICE" and filed with the State Intellectual Property Office of the People's Republic of China on Apr. 28, 2015, both of which applications are incorporated herein by reference in their entireties

FIELD

The present disclosure relates to financial self-service equipment, and in particular to an apparatus for detecting a banknote location in a banknote conveying passage by means of a photoelectric sensor.

BACKGROUND

Banknote control is a necessary function for the financial self-service equipment, and performance of banknote control determines effectiveness of the whole equipment. Usually, a banknote location is detected by a photoelectric sensor arranged in the equipment, and determined according to a state of the photoelectric sensor.

At present, photoelectric sensors in a banknote conveying passage are normally arranged at locations in parallel with and at a certain distance to the passage. When a banknote arrives at the location of any photoelectric sensor, the state of the photoelectric sensor may be changed, thus the banknote is determined to be at the location of the photoelectric sensor in the passage. Although a banknote location in a conveying passage can be detected effectively, there is a blind zone if the number of locations of arranged photoelectric sensors is too small (i.e., a distance between two adjacent photoelectric sensors is greater than a banknote width) to detect some banknote location in the passage. For the financial self-service equipment, the banknote location is an important parameter in a process of banknote control, and the accuracy of a banknote location may directly impact the control effect of a banknote. To better solve the problem of blind zone for detecting a location of a banknote, the number of arranged photoelectric sensors may be increased, which however is costly and even barely feasible especially in the case of a long banknote conveying passage. Therefore, it is desired to provide an apparatus which can solve the problem of blind zone of banknote detection without increasing the number of photoelectric sensors.

SUMMARY

To solve the problem of high cost for reducing blind zone of banknote detection in the conventional technology, the present disclosure provides an apparatus for detecting a banknote location which can solve the problem of blind zone of banknote detection in the conveying passage at a low cost by means of photoelectric sensors arranged in a crisscross pattern.

An apparatus for detecting a banknote location is provided, which is installed in a banknote passage, and the apparatus for detecting a banknote location includes: a first photoelectric sensor installed at an entrance of the banknote passage, a second photoelectric sensor installed at an exit of the banknote passage and a third photoelectric sensor installed in the banknote passage.

The first photoelectric sensor includes a light-emitting end, a light-receiving end, a first reflecting mirror and a second reflecting mirror. The light-emitting end and the light-receiving end are arranged symmetrically on two side ends of the entrance on a lower passage plate of the banknote passage, and a distance between the light-emitting end and the light-receiving end is not more than a length of a banknote to be detected. The first reflecting mirror and the second reflecting mirror are arranged symmetrically on two side ends of the entrance on an upper passage plate of the banknote passage. The first reflecting mirror is located right above the light-emitting end while the second reflecting mirror is located right above the light-receiving end, and both of the first reflecting mirror and the second reflecting mirror are arranged in a face-to-face manner at an inclined angle of 45 degrees, to control a light beam emitted by the light-emitting end to be vertically directed to the first reflecting mirror, then reflected to the second reflecting mirror, and then vertically directed to the light-receiving end via reflection by the second reflecting mirror.

The second photoelectric sensor includes a light-emitting end, a light-receiving end, a third reflecting mirror and a fourth reflecting mirror. The light-emitting end and the light-receiving end are arranged symmetrically on two side ends of the exit on the lower passage plate of the banknote passage, and a distance between the light-emitting end and the light-receiving end is not more than the length of the banknote to be detected. The third reflecting mirror and the fourth reflecting mirror are arranged symmetrically on two side ends of the exit on the upper passage plate of the banknote passage. The third reflecting mirror is located right above the light-emitting end while the fourth reflecting mirror is located right above the light-receiving end, and both of the third reflecting mirror and the fourth reflecting mirror are arranged in a face-to-face manner at an inclined angle of 45 degrees, to control a light beam emitted by the light-emitting end to be directed to the third reflecting mirror, then reflected to the fourth reflecting mirror, and then vertically directed to the light-receiving end via reflection by the fourth reflecting mirror.

The third photoelectric sensor includes a light-emitting end, a light-receiving end, an upper reflecting mirror group and a lower reflecting mirror group. The light-emitting end and the light-receiving end are arranged symmetrically at an entry end and an exit end of the lower passage plate of the banknote passage, and the light-emitting end is located between the light-emitting end of the first photoelectric sensor and the light-receiving end of the first photoelectric sensor while the light-receiving end is located between the lighting-emitting end of the second photoelectric sensor and the light-receiving end of the second photoelectric sensor. The upper reflecting mirror group includes multiple reflecting mirrors while the lower reflecting mirror group includes reflecting mirrors having a number two less than the number of the reflecting mirrors of the upper reflecting mirror group, and the multiple reflecting mirrors of the upper reflecting mirror group are arranged at a uniform interval on the upper passage plate and two of the reflecting mirrors of the upper reflecting mirror group are arranged respectively right above the light-emitting end and the light-receiving end of the third photoelectric sensor. The reflecting mirrors of the lower reflecting mirror group are arranged on the lower passage plate in one-to one correspondence with the other reflecting mirrors of the upper reflecting mirror group, with each pair of opposite upper reflecting mirror and lower reflecting mirror being arranged in a face-to-face and parallel manner. Every two of the multiple reflecting mirrors of the same reflecting mirror group are arranged in a face-to-face manner at an inclined angle of 45 degrees, to control a light emitted by the light-emitting end is vertically directed to the light-receiving end via reflection by the upper reflecting mirror group and the lower reflecting mirror group.

Preferably, a distance between the light-emitting end of the third photoelectric sensor and the reflecting mirror which is the closest to the light-emitting end in the lower reflecting mirror group is smaller than or equal to a width of the banknote to be detected.

Preferably, the multiple reflecting mirrors of the lower reflecting mirror group are arranged at a uniform interval on the lower passage plate and a distance between two adjacent reflecting mirrors is less than or equal to the width of the banknote to be detected.

Preferably, the apparatus for detecting a banknote location further includes a sensor state recording unit and a banknote location determining unit. The sensor state recording unit records states of the three photoelectric sensors, by using 1 to represent a state that a sensor is shielded and 0 to represent a state that a sensor is not shielded.

Preferably, the banknote location determining unit is configured to determine a banknote location according to rules as follows: the states of the three photoelectric sensors are recorded by the sensor state recording unit in a format of ABC, with A representing a state of the first photoelectric sensor, B representing a state of the third photoelectric sensor and C representing a state of the second photoelectric sensor, if a sensor state value is 000, it is determined that the banknote to be detected does not enter into the banknote passage or has left the banknote passage; if the sensor state value is 100, it is determined that the front end of the banknote to be detected just arrives at the entrance of the passage; if the sensor state value is 110, it is determined that the banknote has entered the banknote conveying passage but the rear-end of the banknote has not yet left the entrance of the banknote passage; if the sensor state value is 010, it is determined that the banknote is in the passage and the front end of the banknote has not yet arrived at the exit of the banknote conveying passage; if the sensor state value is 011, it is determined that the front end of the banknote arrives at the exit of the banknote conveying passage; and if the sensor state value is 001, it is determined that the rear-end of the banknote arrives at the exit of the passage and the banknote is about to leave the banknote conveying passage.

Preferably, the apparatus for detecting a banknote location further includes a controlling unit. The controlling unit is configured to record a time t1 when the front end of the banknote arrives at the first photoelectric sensor and a time t2 when the front end of the banknote arrives at the second photoelectric sensor, and calculate a distance between the banknote in the banknote passage and the first photoelectric sensor at the entrance of the banknote passage by applying a formula $L=V*(t-t1)$ from a passage speed V, the recorded time t1, the recorded time t2 and a time t between t1 and t2.

Compared with the conventional technology, the present disclosure has advantages as follows.

Firstly, a location of a banknote in a banknote passage can be determined just by three photoelectric sensors, which is easy to implement.

Secondly, experiments shows that any locations of the banknote in a banknote passage can be determined accurately, thereby effectively solving the problem of blind zone of banknote detection in the convention technology. Furthermore, the apparatus has a low cost to be used for banknote control.

DETAILED DESCRIPTION OF THE EMBODIMENTS

Provided in embodiments of the present disclosure is an apparatus for detecting a banknote location. The apparatus includes three photoelectric sensors, which are arranged respectively at the entrance, exit, and inside of a banknote passage. The components of the apparatus and the working principle are illustrated hereinafter with reference to the drawings.

Figure 1:
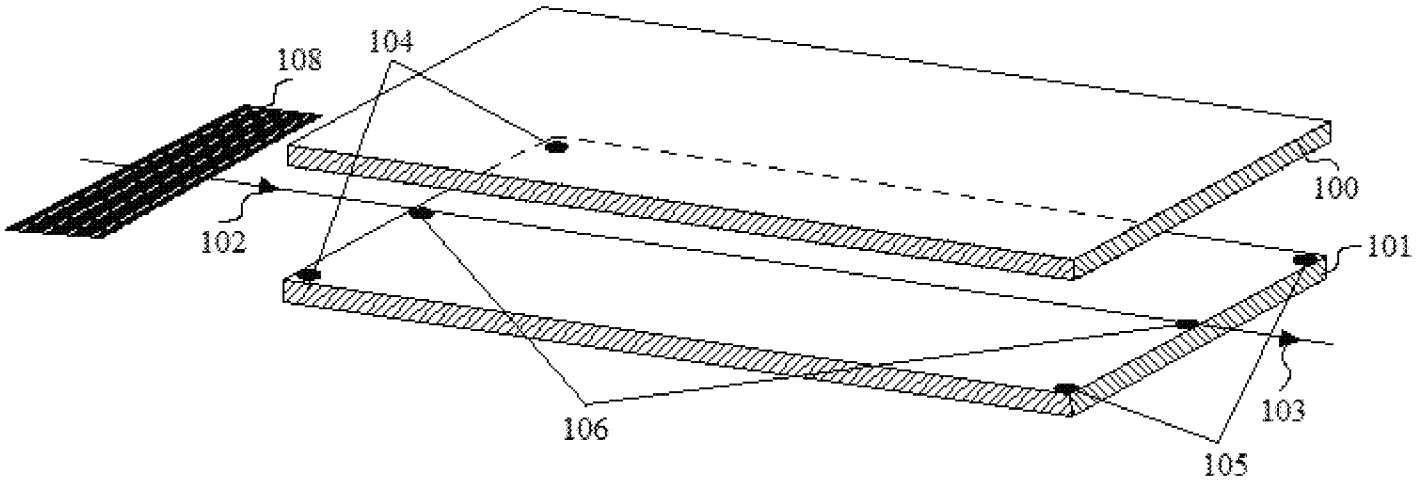
FIG. 1 is a schematic diagram illustrating a banknote passage according to a preferable embodiment in the present disclosure.

As shown in FIG. 1, the structure of a banknote passage according to an embodiment of the present disclosure is described with an example of a banknote passage inside an ATM (Automatic Teller Machine). The banknote passage mainly includes: an upper part 100 of the banknote passage, a lower part 101 of the banknote passage, an entrance 102 of the banknote passage and an exit 103 of the banknote passage. The apparatus for detecting a banknote location is arranged in the banknote passage, including: a photoelectric sensor 104 installed at the entrance of the banknote passage, a second photoelectric sensor 105 installed at the exit of the banknote passage and a third photoelectric sensor 106 installed in the banknote passage, each photoelectric sensor including a light transmission path. When a light transmission path is shielded by a banknote 108, a state of the photoelectric sensor changes correspondingly. Therefore, the zone where the banknote is located at may be determined according to a combination of the states of the three photoelectric sensors, and then a specific location of the banknote may be calculated according to the transmission speed of the banknote passage and the time when the photoelectric sensor state changes.

Figure 2:
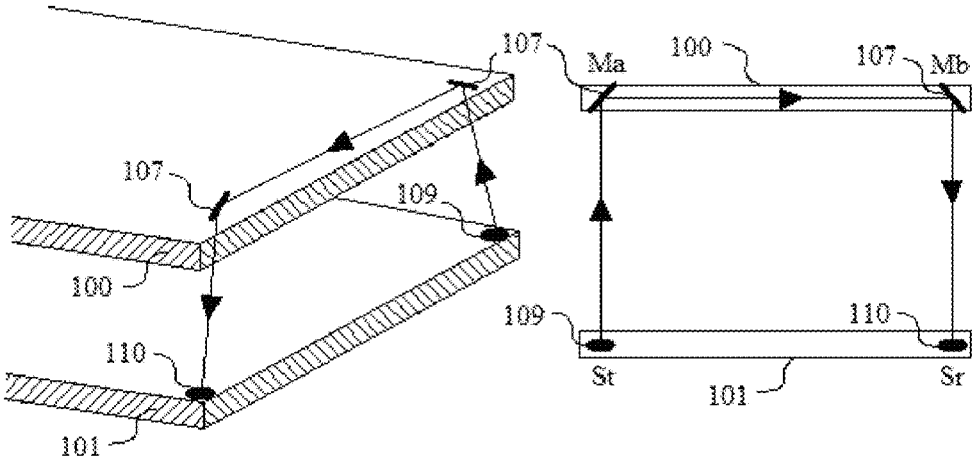
FIG. 2 is a schematic diagram illustrating the detection principle of a first photoelectric sensor.

FIG. 2 is a schematic diagram illustrating the detection principle of the first photoelectric sensor 104 installed at the entrance of the banknote passage. It is noted that, the second photoelectric sensor 105 installed at the exit of the banknote passage has the same structure and detection principle, and only the photoelectric sensor 104 is taken as an example to illustrate hereinafter. Both a light-emitting end 109 and a light-receiving end 110 of the photoelectric sensor 104 are installed on a lower part of the banknote passage. The light from the light-emitting end St of the photoelectric sensor 104 is vertically emitted to a first reflecting mirror Ma on the upper passage plate of the banknote passage. As the first reflecting mirror Ma is arranged at an inclined angle of 45 degrees, after being reflected by the reflecting mirror Ma, the light arrives horizontally at a second reflecting mirror Mb on the other side of the upper passage plate. Then the light arrives at the light-receiving end Sr after being reflected by the second reflecting mirror Mb. Therefore the light transmission path is: St→Ma→Mb→Sr, where the light path Ma→Mb is guaranteed by the structure to be not shielded. Since the banknote is conveyed in a direction of the banknote width in the banknote conveying passage, when a distance between St and Sr is smaller than or equal to the banknote length, at least one of the light path St→Ma and the light path Mb→Sr is shielded once the banknote enters into the passage, that is, light emitted by the light-emitting end St is shielded and cannot arrive at the light-receiving end Sr. Thus a state of this photoelectric sensor is determined to be a shielded state. Otherwise the state of the group of photoelectric sensors is determined to be an unshielded state.

Figure 3:
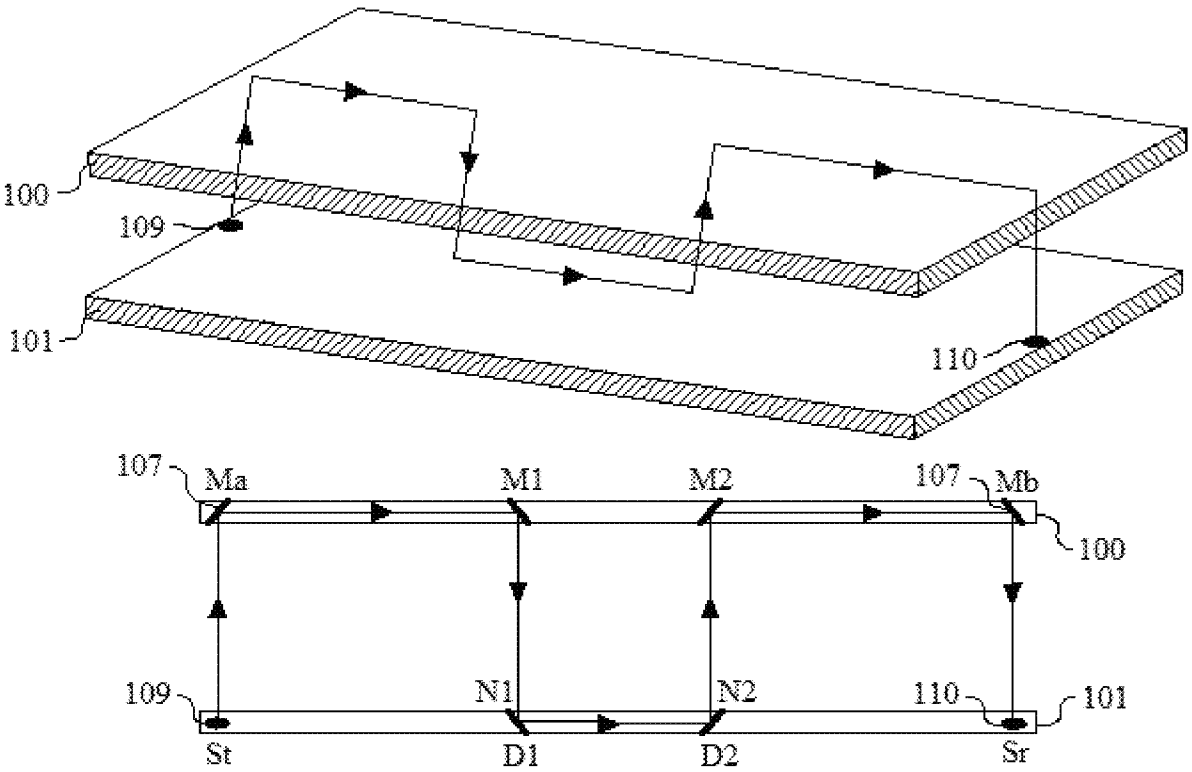
FIG. 3 is a schematic diagram illustrating the detection principle of a third photoelectric sensor.

FIG. 3 is a schematic diagram illustrating the structure and detection principle of a third photoelectric sensor 106 installed in the banknote passage. A light-emitting end St of the photoelectric sensor 106 is installed at the entrance on a lower passage plate of the banknote passage, while a light-receiving end Sr is installed at the exit on the lower passage plate of the banknote passage. Similar to the detection principle of the first photoelectric sensor 104 installed at the entrance of the banknote passage, a light is emitted from St and finally arrives at Sr. Since the passage length is far greater than a banknote width W, if only two reflecting mirrors (Ma and Mb) are used to transmit the light, when a banknote is located in a zone between St and Sr, the banknote cannot shield the light path St→Sr, thus a blind zone for banknote detection is formed. To make sure that a banknote at any location in the banknote passage can shield the light path St→Sr, an upper reflecting mirror group is arranged on the upper passage plate of the banknote passage in the embodiment of the present disclosure, including reflecting mirror M1, M2 . . . Mn, and a lower reflecting mirror group is arranged on the lower passage plate of a banknote passage, including reflecting mirror N1, N2 . . . Nn. Thus the light arrives at M1 from Ma, then arrives at the reflecting mirror N1 on the lower passage plate, then arrives at the reflecting mirror N2 after being reflected by N1, then arrives at the reflecting mirror M2 after being reflected by N2, then arrives at the reflecting mirror Mb after being reflected by M2, and finally the light arrives at Sr after being reflected by Mb, forming the whole light path of St→Ma→M1→N1→N2→M2→Mb→Sr. It is equivalent to that, the lower part of the banknote passage is divided into multiple small regions by the locations of the reflecting mirrors N1, N2 . . . Nn, to make sure a banknote at any location in the banknote passage can shield the light path St→Sr under the condition that an adjacent distance of St→D1→D2→Dn→ . . . →Sr is less than the banknote width, that is, a distance between the light-emitting end St and a setting point D1 of the reflecting mirror N1, a distance between setting points of any adjacent ones of the reflecting mirrors N1, N2 . . . Nn, and a distance between the last reflecting mirror Nn and the light-receiving end Sr are all less than the banknote width. Thus, whether there is a banknote in the passage can be determined according to whether the state of the photoelectric sensor is a shielded state or an unshielded state.

Figure 4:
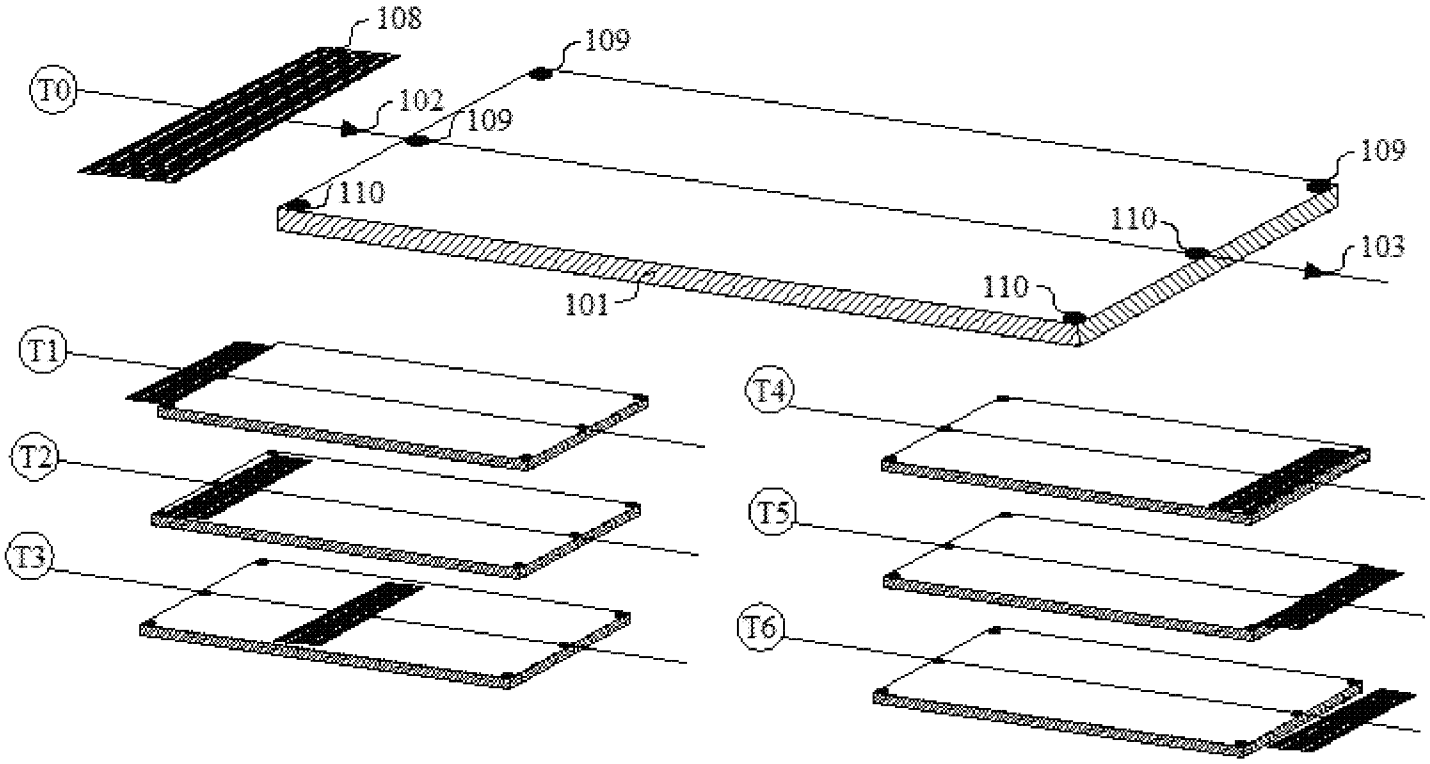
FIG. 4 is a schematic diagram illustrating locations of a banknote in a banknote passage.

FIG. 4 is a schematic diagram illustrating locations of a banknote in the banknote passage. Taking the light-emitting end St of the third photoelectric sensor 106 installed in the banknote passage as the original point, and taking the light-receiving end Sr of the third photoelectric sensor 106 as the terminal point, the distance D between the front end of a banknote and the original point represent a location of the banknote in the banknote passage. Transmission situations of a banknote in the passage successively include: the banknote has not yet arrived at the entrance of the passage T0→ the front end of the banknote arrived at the entrance of the passage T1→ the rear-end of the banknote arrived at the entrance of the passage T2→ the banknote is in the passage T3→ the front end of the banknote arrives at the exit of the passage T4→ the rear-end of the banknote arrives at the exit of the passage T5→ the rear-end of the banknote has left the exit of the passage T6.

Figure 5:
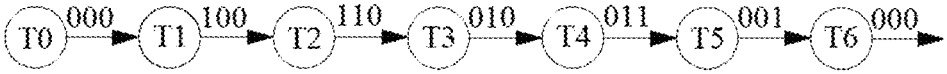
FIG. 5 is a schematic diagram illustrating correspondence between banknote locations and photoelectric sensor states.

FIG. 5 is a schematic diagram illustrating correspondence between banknote locations and photoelectric sensor states. The apparatus for detecting a banknote location further includes a sensor state recording unit and a banknote location determining unit. The sensor state recording unit can record states of the three photoelectric sensors respectively in a recording format of ABC, which are labeled above arrows in sequence in the figure. In the recording format of ABC, A denotes a state of the first photoelectric sensor 104 installed at the entrance of the passage, B denotes a state of the third photoelectric sensor 106 in the passage and C denotes a state of the second photoelectric sensor 105 at the exit of the passage. The value 1 represents the state that a photoelectric sensor is shielded while 0 represents the state that a photoelectric sensor is not shielded. When a banknote is in location T0, that is, before the front end of the banknote arriving at the entrance of a banknote passage, none of the three photoelectric sensors is shielded, so the photoelectric sensor state is represented as 000. When the banknote is in location T1, that is, when the front end of the banknote just arrives at the entrance of the banknote passage, the first photoelectric sensor 104 is shielded, while the second photoelectric sensor 105 and the third photoelectric sensor 106 are not shielded, so the photoelectric sensor state is represented as 100. When the banknote continues entering into the passage from location T1 and arrives at location T2, that is, when the rear-end of the banknote just arrives at the entrance of the passage, the first photoelectric sensor 104 and the third photoelectric sensor 106 are both shielded while the second photoelectric sensor 105 is not shielded, so the photoelectric sensor state is represented as 110. When the banknote is in location T3, that is, when the banknote is still in the passage and the front end of the banknote has not yet arrived at the exit of the passage, the third photoelectric sensor 106 is shielded, and the first photoelectric sensor 104 and the second photoelectric sensor 105 are not shielded, so the photoelectric sensor state is represented as 010. When the banknote is in location T4, that is, when the front end of the banknote arrives at the exit of the passage, the second photoelectric sensor 105 and the third photoelectric sensor 106 are both shielded while the first photoelectric sensor 104 is not shielded, so the photoelectric sensor state is represented as 011. When the banknote is in location T5, that is, when the rear-end of the banknote arrives at the exit of the passage, the second photoelectric sensor 105 is shielded, while the first photoelectric sensor 104 and the third photoelectric sensor 106 are not shielded, so the photoelectric sensor state is represented as 001. When the banknote is in location T6, that is, when the rear-end of the banknote has left the exit of the passage, none of the three photoelectric sensors is shielded, so the photoelectric sensor state is represented as 000.

Denoting a width of the banknote as W, a length of the banknote as L and a length of the passage as S, a distance between the light-emitting end and the light-receiving end of the first photoelectric sensor 104 at the entrance of the passage is arranged to be less than the banknote length L, and the second photoelectric sensor 105 is arranged in the same manner. Then when a banknote is entering into the entrance of a banknote passage or is leaving from the exit of a banknote passage, the first photoelectric sensor 104 at the entrance of the passage or the second photoelectric sensor 105 at the exit of the passage can detect that the light path is shielded, thus determining directly that the banknote is located at the entrance of the banknote passage or at the exit of the banknote passage. A distance between the light-emitting end and the light-receiving end of the third photoelectric sensor 106 in the passage is equal to the passage length S. Since S is far greater than the banknote width W, the light path from the light-emitting end to the light-receiving end of the third photoelectric sensor 106 in the passage is divided into N parts, where a length of each part of the light path is ensured to be less than the banknote width W by means of the reflecting mirror group described above. In this way, once a banknote enters into the banknote passage, the third photoelectric sensor 106 in the passage is in a shielded state. Then according to a time when the banknote shields the first photoelectric sensor 104 at the entrance of the passage and a time a second photoelectric sensor 105 at the exit of the passage and according to a passage speed V, a travelled distance of the banknote in the banknote passage during time T can be calculated by using a formula S=V*T, thereby calculating a relative location of the banknote to the first photoelectric sensor 104 at the entrance of the passage and a relative location of the banknote to the second photoelectric sensor 105 at the exit of the passage. For example, the apparatus for detecting a banknote location may also include a controlling unit, which is configured to record a time t1 when the front end of the banknote arrives at the first photoelectric sensor and a time t2 when the front end of the banknote arrives at the second photoelectric sensor. Based on a passage speed V, the recorded time t1, the recorded time t2, and a time t between t1 and t2, a relative location of the banknote in the banknote passage to the first photoelectric sensor at the entrance of the banknote passage is calculated by using a formula L=V*(t−t1).

The foregoing descriptions are merely preferred embodiments of the present disclosure, and it is important to note that, the above preferred embodiments should not be understood to limit the present disclosure. The protection scope of the present disclosure is in accordance with the protection scope defined by the claims. For the person skilled in the art, many modifications and improvements may be made without departing from the principle of the present disclosure, and these modifications and improvements are also deemed to fall into the protection scope of the present disclosure.

The invention claimed is:

1. An apparatus for detecting a banknote location, which is installed in a banknote passage, the apparatus comprising:

a first photoelectric sensor installed at an entrance of the banknote passage, wherein the first photoelectric sensor comprises a first light-emitting end, a first light-receiving end, a first reflecting mirror and a second reflecting mirror; the first light-emitting end and the first light-receiving end are arranged symmetrically on two side ends of an entrance on a lower passage plate of the banknote passage, and a distance between the first light-emitting end and the first light-receiving end is not more than a length of a banknote to be detected; the first reflecting mirror and the second reflecting mirror are arranged symmetrically on two side ends of an entrance on an upper passage plate of the banknote passage, the first reflecting mirror is located right above the first light-emitting end while the second reflecting mirror is located right above the first light-receiving end, and both of the first reflecting mirror and the second reflecting mirror are arranged in a face-to-face manner at an inclined angle of 45 degrees, to control a light beam emitted by the first light-emitting end to be vertically directed to the first reflecting mirror, then reflected to the second reflecting mirror, and then vertically directed to the first light-receiving end via reflection by the second reflecting mirror;

a second photoelectric sensor installed at an exit of the banknote passage, wherein the second photoelectric sensor comprises a second light-emitting end, a second light-receiving end, a third reflecting mirror and a fourth reflecting mirror; the second light-emitting end and the second light-receiving end are arranged symmetrically on two side ends of an exit on the lower passage plate of the banknote passage, and a distance between the second light-emitting end and the second light-receiving end is not more than the length of the banknote to be detected; the third reflecting mirror and the fourth reflecting mirror are arranged symmetrically on two side ends of the exit on the upper passage plate of the banknote passage, the third reflecting mirror is located right above the second light-emitting end while the fourth reflecting mirror is located right above the second light-receiving end, and both of the third reflecting mirror and the fourth reflecting mirror are arranged in a face-to-face manner at an inclined angle of 45 degrees, to control a light beam emitted by the second light-emitting end to be directed to the third reflecting mirror, then reflected to the fourth reflecting mirror, and then vertically directed to the second light-receiving end via reflection by the fourth reflecting mirror; and a third photoelectric sensor installed in the banknote passage, wherein the third photoelectric sensor comprises a third light-emitting end, a third light-receiving end, an upper reflecting mirror group and a lower reflecting mirror group; the third light-emitting end and the third light-receiving end are arranged symmetrically at an entry end and an exit end of the lower passage plate of the banknote passage, and the third light-emitting end is located between the first light-emitting end of the first photoelectric sensor and the first light-receiving end of the first photoelectric sensor while the third light-receiving end is located between the second lighting-emitting end of the second photoelectric sensor and the second light-receiving end of the second photoelectric sensor; the upper reflecting mirror group comprises a plurality of reflecting mirrors while the lower reflecting mirror group comprises reflecting mirrors having a number two less than a number of the reflecting mirrors of the upper reflecting mirror group, and the plurality of reflecting mirrors of the upper reflecting mirror group are arranged at a uniform interval on the upper passage plate and two of the reflecting mirrors of the upper reflecting mirror group are arranged respectively right above the third light-emitting end and the third light-receiving end of the third photoelectric sensor, and the reflecting mirrors of the lower reflecting mirror group are arranged on the lower passage plate in one-to one correspondence with the reflecting mirrors of the upper reflecting mirror group, with each pair of opposite upper reflecting mirror and lower reflecting mirror being arranged in a face-to-face and parallel manner; each pair of reflecting mirrors of the same reflecting mirror group are arranged in a face-to-face manner at an inclined angle of 45 degrees, to control a light emitted by the third light-emitting end is vertically directed to the third light-receiving end via reflection by the upper reflecting mirror group and the lower reflecting mirror group.

2. The apparatus for detecting a banknote location according to claim 1, wherein a distance between the third light-emitting end of the third photoelectric sensor and the reflecting mirror which is the closest to the third light-emitting end in the lower reflecting mirror group is smaller than or equal to a width of the banknote to be detected.

3. The apparatus for detecting a banknote location according to claim 2, wherein the plurality of reflecting mirrors of the lower reflecting mirror group are arranged at a uniform interval on the lower passage plate and a distance between two adjacent reflecting mirrors is less than or equal to the width of the banknote to be detected.

4. The apparatus for detecting a banknote location according to claim 1, further comprising a sensor state recording unit and a banknote location determining unit, wherein the sensor state recording unit records states of the first, second, and third photoelectric sensors, by using 1 to represent a shielded from light state and 0 to represent an unshielded from light state.

5. The apparatus for detecting a banknote location according to claim 4, wherein the banknote location determining unit is configured to determine a banknote location according to rules as follows:

the states of the first, second, and third photoelectric sensors are recorded by the sensor state recording unit in a format of ABC, with A representing a state of the first photoelectric sensor, B representing a state of the third photoelectric sensor and C representing a state of the second photoelectric sensor, if a sensor state value is 000, it is determined that the banknote to be detected does not enter into the banknote passage or has left the banknote passage;

if the sensor state value is 100, it is determined that a front end of the banknote to be detected just arrives at the entrance of the banknote passage;

if the sensor state value is 110, it is determined that the banknote has entered a banknote conveying passage but a rear-end of the banknote has not yet left the entrance of the banknote passage;

if the sensor state value is 010, it is determined that the banknote is in the banknote conveying passage and the front end of the banknote has not yet arrived at the exit of the banknote conveying passage;

if the sensor state value is 011, it is determined that the front end of the banknote arrives at the exit of the banknote conveying passage; and if the sensor state value is 001, it is determined that the rear-end of the banknote arrives at the exit of the banknote conveying passage and the banknote is about to leave the banknote conveying passage.

6. The apparatus for detecting a banknote location according to claim 5, further comprising a controlling unit, which is configured to record a time t1 when the front end of the banknote arrives at the first photoelectric sensor and a time t2 when the front end of the banknote arrives at the second photoelectric sensor, and calculate a distance between the banknote in the banknote passage and the first photoelectric sensor at the entrance of the banknote passage by a formula $L=V*(t-t1)$ from a passage speed V, the recorded time t1, the recorded time t2 and a time t between t1 and t2.

* * * * *